US006294516B1

(12) United States Patent
Jacques et al.

(10) Patent No.: US 6,294,516 B1
(45) **Date of Patent: *Sep. 25, 2001**

(54) WASH CYCLE UNIT DOSE SOFTENER

(75) Inventors: Alain Jacques, Blegny; Juliette Rousselet, Glons; Hoai-Chau Cao, Ans, all of (BE)

(73) Assignee: Colgate-Palmolive Co., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/620,515

(22) Filed: Jul. 20, 2000

Related U.S. Application Data

(63) Continuation-in-part of application No. 09/558,822, filed on Apr. 26, 2000, now Pat. No. 6,258,767.

(51) Int. Cl.[7] ..... C11D 3/12
(52) U.S. Cl. ..... 510/515; 510/507
(58) Field of Search ..... 510/507, 515

(56) References Cited

U.S. PATENT DOCUMENTS 4,166,039 * 8/1979 Wise ..... 252/110
4,740,326 * 4/1988 Hortel et al. ..... 252/90
5,225,100 * 7/1993 Fry et al. ..... 252/174.25
5,773,408 * 6/1998 Trinh et al. ..... 510/520
5,955,057 * 9/1999 Maunder et al. ..... 424/44
6,110,886 * 8/2000 Scepanski ..... 510/515
6,159,126 * 12/2000 Crutzen et al. ..... 510/515

FOREIGN PATENT DOCUMENTS

WO 97/03959 * 2/1997 (WO) .
WO 00/03959 * 1/2000 (WO) .

* cited by examiner

*Primary Examiner*—John Hardee
(74) *Attorney, Agent, or Firm*—Bernard Lieberman

(57) ABSTRACT

A unit dose wash cycle fabric softening composition for softening or conditioning fabrics in the wash cycle of an automatic washing machine, said unit dose comprising (a) a compacted granular fabric softener composition or (b) an encapsulated liquid and/or granular fabric softener composition, the amount of (a) or (b) being sufficient to form a unit dose capable of providing effective softening or conditioning of fabrics in the wash cycle of said washing machine.

15 Claims, No Drawings

WASH CYCLE UNIT DOSE SOFTENER

This application is a continuation-in-part of application Ser. No. 09/558,822 filed Apr. 26, 2000, now U.S. Pat. No. 6,258,767 the disclosure of which is incorporated herein by reference.

FIELD OF THE INVENTION

This invention relates to wash cycle unit dose laundry compositions for softening or conditioning fabrics. More particularly, this invention relates to unit dose fabric softening compositions which are compacted granular compositions or encapsulated liquid or granular compositions suitable for use in the wash cycle of an automatic washing machine.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound which will adequately disperse in the wash water.

Although detergent compositions in the form of compacted granular tablets of various shapes have received much attention in the patent literature, the use of such tablets to provide a unit dose fabric softener which will soften or condition fabrics in the wash cycle without impairing detergency or otherwise compromise the cleaning benefits provided by the detergent composition is not known.

Another possible option for providing a unit dose softener apart from the wash cycle is to introduce the softening ingredients directly into the rinse cycle. But, for this type of product to be effective several practical requirements must be met. To begin with, the size and shape of the unit dose container must be readily compatible with the geometry of a wide variety of rinse cycle dispensers designed for home washing machines in order to insure its easy introduction into the dispenser. Moreover, in common with the general use of rinse cycle softeners, it is necessary to clean the rinse dispenser on a regular basis to avoid residue from accumulating within the dispenser or even, at times, prevent bacterial growth from occurring.

Still further, a unit dose composition for the rinse cycle must be formulated to readily dispense its contents upon contact with water in a period of time corresponding to the residence time of the unit dose in the dispenser, namely, the period of time during which water enters and flows through the rinse cycle dispenser. The aforementioned practical requirements have to date not been successfully met with any commercially available product and hence there remains a need in the art for a unit dose softener capable of activation in the rinse cycle.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569,773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water. It has now been found that softening of laundry can be effected in the wash cycle with a flexibility which is independent of the detergent dosage, and with great convenience by the consumer by the use of a unit dose wash cycle softener which avoids the common problems associated with the pouring and handling of granular or liquid detergent compositions.

SUMMARY OF THE INVENTION

The present invention provides a unit dose wash cycle fabric softening composition for softening or conditioning fabrics in the wash cycle of an automatic washing machine, said unit dose comprising (a) a compacted granular fabric softener composition or (b) an encapsulated liquid and/or granular fabric softener composition, the amount of (a) or (b) being sufficient to form a unit dose capable of providing effective softening or conditioning of fabrics in the wash cycle of said washing machine.

In a preferred embodiment the unit dose fabric softening composition is characterized by being in the form of a tablet and having no discrete outer layer surrounding the fabric softener comprised of an alkaline material such that the pH of the wash water is increased upon dissolution of said outer layer in said wash water.

The term "granular" as used herein in describing the fabric softener is intended to encompass relatively coarser granules varying in size from about 150 to 2,000 microns as well as finer powder having a size as small as 30 to 50 microns.

The term "fabric softener" is used herein for purposes of convenience to refer to materials which provide softening and/or conditioning benefits to fabrics in the wash cycle of a home or automatic laundering machine.

The compacted granular fabric softener composition of the invention is preferably comprised of a fabric softening clay optionally in combination with an organic fatty softening material. Especially preferred fabric softeners comprise a clay mineral softener, such as bentonite, in combination with a pentaerythritol ester compound as further described herein. Useful combinations of such softener may vary from about 80%, to about 90%, by weight, of clay, and from about 10% to about 20%, by weight, of fatty softening material such as a pentaerythritol compound (often abbreviated herein as "PEC").

The encapsulated liquid or granular fabric softener composition contemplated for use herein comprises a gelatin capsule containing a nonionic softener or clay to avoid any reaction with anionic surfactants which may be present in the wash liquor. Useful liquid softening compositions include fatty alcohols, fatty acids, fatty esters, silicones (e.g. linear, grafted, crosslinked or ethoxylated), polyethylene waxes and fatty amides.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The clays that are useful components of the invented products are those which cooperate with the organic fatty softener materials to provide enhanced softening of laundry. Such clays include the montmorillonite-containing clays which have swelling properties (in water) and which are of smectite structure, so that they deposit on fibrous materials, especially cotton and cotton/synthetic blends, such as cotton/polyester, to give such fibers and fabrics made from them a surface lubricity or softness. The best of the smectite clays for use in the present invention is bentonite and the best of the bentonites are those which have a substantial swelling capability in water, such as the sodium and potassium bentonites. Such swelling bentonites are also known as western or Wyoming bentonites, which are essentially sodium bentonite. Other bentonites, such as calcium bentonite, are normally non-swelling and usually are, in themselves, unacceptable as fabric softening agents. However, it has been found that such non-swelling bentonites exhibit even better fabric softening in combination with PEC's than do the swelling bentonites, provided that there is present in the softening composition, a source of alkali metal or other solubilizing ion, such as sodium (which may come from sodium hydroxide, added to the composition, or from sodium salts, such as builders and fillers, which may be functional components of the composition). Among the preferred bentonites are those of sodium and potassium, which are normally swelling, and calcium and magnesium, which are normally non-swelling. Of these it is preferred to utilize calcium (with a source of sodium being present) and sodium bentonites. The bentonites employed may be produced in the United States of America, such as Wyoming bentonite, but also may be obtained from Europe, including Italy and Spain, as calcium bentonite, which may be converted to sodium bentonite by treatment with sodium carbonate, or may be employed as calcium bentonite. Also, other montmorillonite-containing smectite clays of properties like those of the bentonites described may be substituted in whole or in part for the bentonites described herein and similar fabric softening results will be obtained.

The swellable bentonites and similarly operative clays are of ultimate particle sizes in the micron range, e.g., 0.01 to 20 microns and of actual particle sizes in the range of No's. 100 to 400 sieves, preferably 140 to 325 sieves, U.S. Sieve Series. The bentonite and other such suitable swellable clays may be agglomerated to larger particle sizes too, such as 60 to 120 sieves, but such agglomerates are not preferred unless they include the PEC('s) too (in any particulate products).

A main component of the invented compositions and articles of the present invention, and which is used in combination with the fabric softening clay is an organic fatty softener. The organic softener can be anionic, cationic or nonionic fatty chains ($C_{10}$–$C_{22}$ preferably $C_{12}$–$C_{18}$). Anionic softeners include fatty acids soaps. Preferred organic softeners are nonionics such as fatty esters, ethoxylated fatty esters, fatty alcohols and polyols polymers. The organic softener is most preferably a higher fatty acid ester of a pentaerythritol compound, which term is used in this specification to describe higher fatty acid esters of pentaerythritol, higher fatty acid esters of pentaerythritol oligomers, higher fatty acid esters of lower alkylene oxide derivatives of pentaerythritol and higher fatty acid esters of lower alkylene oxide derivatives of pentaerythritol oligomers. Pentaerythritol compound is often abbreviated as PEC herein, which description and abbreviation may apply to any or all of pentaerythritol, oligomers, thereof and alkoxylated derivatives thereof, as such, or more preferably and more usually, as the esters, as may be indicated by the context.

The oligomers of pentaerythritol are preferably those of two to five pentaerythritol moieties, more preferably 2 or 3, with such moieties being joined together through etheric bonds. The lower alkylene oxide derivatives thereof are preferably of ethylene oxide or propylene oxide monomers, dimers or polymers, which terminate in hydroxyls and are joined to the pentaerythritol or oligomer of pentaerythritol through etheric linkages. Preferably there will be one to ten alkylene oxide moieties in each such alkylene oxide chain, more preferably 2 to 6, and there will be one to ten such groups on a PEC, depending on the oligomer. At least one of the PEC OH groups and preferably at least two, e.g., 1 or 2 to 4, are esterified by a higher fatty acid or other higher aliphatic acid, which can be of an odd number of carbon atoms.

The higher fatty acid esters of the pentaerythritol compounds are preferably partial esters. And more preferably there will be at least two free hydroxyls thereon after esterification (on the pentaerythritol, oligomer or alkoxyalkane groups). Frequently, the number of such free hydroxyls is two or about two but sometimes it may by one, as in pentaerythritol tristearate. The higher aliphatic or fatty acids that may be employed as esterifying acids are those of carbon atom contents in the range of 8 to 24, preferably 12 to 22 and more preferably 12 to 18, e.g., lauric, myristic, palmitic, oleic, stearic and behenic acids. Such may be mixtures of such fatty acids, obtained from natural sources, such as tallow or coconut oil, or from such natural materials that have been hydrogenated. Synthetic acids of odd or even numbers of carbon atoms may also be employed. Of the fatty acids lauric and stearic acids are often preferred, and such preference may depend on the pentaerythritol compound being esterified.

Examples of some esters (PEC's) within the present invention follow:

Monopentaerythritol Esters

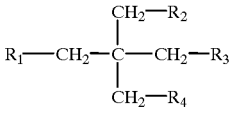

Monopentaerythritol Dilaurate $R_1$=$CH_3$—$(CH_2)_{10}$—COO—

$R_2$=$CH_3$—$(CH_2)_{10}$—COO—

$R_3$=OH $R_4$=OH

Monopentaerythritol Monostearate $R_1$=$CH_3$—$(CH_2)_{16}$—COO—

$R_2$=OH $R_3$=OH $R_4$=OH

Monopentaerythritol Distearate $R_1$=$CH_3$—$(CH_2)_{16}$—COO—
$R_2$=$CH_3$—$(CH_2)_{16}$—COO—
$R_3$=OH
$R_4$=OH Monopentaerythritol Tristearate $R_1$=$CH_3$—$(CH_2)_{16}$—COO—
$R_2$=$CH_3$—$(CH_2)_{16}$—COO—
$R_3$=$CH_3$—$(CH_2)_{16}$—COO—
$R_4$=OH Monopentaerythritol Monobehenate $R_1$=$CH_3$—$(CH_2)_{20}$—COO—
$R_2$=OH
$R_3$=OH
$R_4$=OH Monopentaerythritol Dibehenate $R_1$=$CH_3$—$(CH_2)_{20}$—COO—
$R_2$=$CH_3$—$(CH_2)_{20}$—COO—
$R_3$=OH
$R_4$=OH Dipentaerythritol Esters

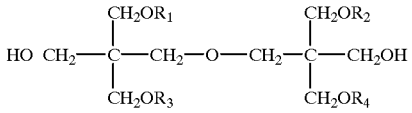

Dipentaerythritol Tetralaurate $R_1$=$CH_3$—$(CH_2)_{10}$—CO
$R_2$=$CH_3$—$(CH_2)_{10}$—CO
$R_3$=$CH_3$—$(CH_2)_{10}$—CO
$R_4$=$CH_3$—$(CH_2)_{10}$—CO Dipentaerythritol Tetrastearate $R_1$=$CH_3$—$(CH_2)_{16}$—CO
$R_2$=$CH_3$—$(CH_2)_{16}$—CO
$R_3$=$CH_3$—$(CH_2)_{16}$—CO
$R_4$=$CH_3$—$(CH_2)_{16}$—CO Pentaerythritol 10 Ethylene Oxide Ester

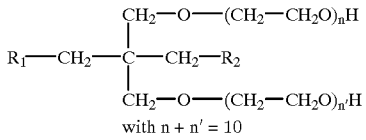

with n + n′ = 10

Monopentaerythritol 10 Ethylene Oxide Distearate $R_1$=$CH_3$—$(CH_2)_{16}$—COO—
$R_2$=$CH_3$—$(CH_2)_{16}$—COO—

Pentaerythritol 4 Propylene Oxide Esters

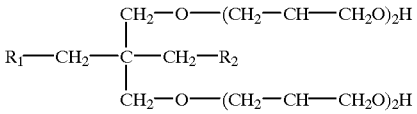

Monopentaerythritol 4 Propylene Oxide Monostearate $R_1$=$CH_3$—$(CH_2)_{16}$—COO—
$R_2$=OH Monopentaerythritol 4 Propylene Oxide Distearate $R_1$=$CH_3$—$(CH_2)_{16}$—COO—
$R_2$=$CH_3$—$(CH_2)_{16}$—COO—

Although in the formulas given herein some preferred pentaerythritol compounds that are useful in the practice of this invention are illustrated it will be understood that various other such pentaerythritol compounds within the description thereof may also be employed herein, including such as pentaerythritol dihydrogenated tallowate, pentaerythritol ditallowate, pentaerythritol dipalmitate, and dipentaerythritol tetratallowate.

To enhance the softening efficacy of the unit dose compositions described herein cationic softeners such as conventional quaternary ammonium softening compounds may optionally be added in minor amounts.

The combination of bentonite and organic fatty softening material is generally from about 10% to about 100% bentonite and from about 1% to about 100% fatty softening material, preferably from about 50% to about 95% bentonite and about 5% to about 50% fatty softening material, and most preferably from about 80% to 90% bentonite and from about 10% to about 20% fatty softening material.

Other useful ingredients for the unit dose compacted granular compositions of the invention include disintegration materials to enhance the disintegration of the unit dose in the wash water. Such materials include an effervescent matrix such as citric acid combined with baking soda, or materials such as PVP polymer and cellulose. Granulating agents may be used such as polyethylene glycol; bactericides, perfumes, dyes and materials to protect against color fading, dye transfer, anti-pilling and anti-shrinkage. For purposes of enhancing the aesthetic properties of the final composition, cosmetic ingredients such as dyes, micas and waxes may be used as coating ingredients to improve the appearance and feel of the unit dose.

The encapsulation provided for the liquid or granular softening or conditioning materials is preferably a gelatin shell which is readily soluble in the wash water and compatible with detergents used in the wash cycle. The manufacture of such gelatin capsules utilizes technology well known in the art and is described, for example, in the following publications which are incorporated herein by reference: "Softgels: Manufacturing Considerations", Paul Wilkinson and Foo Song Hom, Drugs Pharmaceutical Science (1990), pps. 409–449, Mediventure Inc., Ann Arbor, Mich., USA; and "Coating of Gelatin Capsules", Ann Mari Hannula and Peter Speiser, Acta Pharmaceutical Technology (1988), pps. 234–236.

Preferred liquid softeners of the invention include fatty alcohols, such as oleyl alcohol, fatty acids, such as oleyl carboxylic acid; fatty esters, such as oleyl esters or vegetable fatty esters such as sunflower oil; silicones, such as polydimethylsiloxanes, linear or crosslinked, ethoxylated or without ethoxylation and optionally including an amide functionality; polyethylene waxes, having a molecular weight of from 8,000 to 60,000; and fatty amides, such as dioleyl amide formed by the reaction of diethylene triamine with oleic acid having predominantly the following structure:

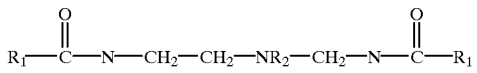

wherein $R_1$ represents an oleyl alkyl carbon chain; and $R_2$ represents H or $(EO)_x$ with x varying from 0 to 6 (the degree of ethoxylation).

While the oleyl carbon chain length is most preferred for purposes of providing softening efficacy and dispersion in the wash water, other higher alkyl chain lengths may also be used for the invention.

Typical unit dose compositions for use herein may vary from about 5 to about 10 ml corresponding on a weight basis to about 5 to about 10 grams (which includes the weight of the capsule), and the number of doses per wash is two.

Alternatively, when using 1 unit dose/wash, the corresponding volume and weight is from about 10 to about 20 ml and from about 10 to about 20 grams (including the capsule weight), respectively.

| | Weight Percent |
|---|---|
| Clay/Pentaerythritol ditallowate (PDT) in a ratio of 83%:17% | 79.97% |
| Effervescent matrix of baking soda and citric acid | 17% |
| Polyvinylpyrrolidone | 1% |
| Perfume | 2% |
| Dye | 0.03% |

This method of manufacture consisted of mixing all the ingredients with the exception of perfume in a Loedige-type mixer. The resulting blend was dried in an oven and perfume was then added to the dried powder. The powder was then compacted using an alternative or rotative press mounted with appropriate dyes. The weight of the spherical unit dose was 60 g and such unit dose dispersed in water within 20 minutes when introduced in the wash load at the beginning of the wash in a European Miele W832 front loading washing machine set a Program White Colors at 40° C.

The softness provided by the unit dose compositions on terry towels, cotton tee-shirts and cotton kitchen towels was evaluated after cumulative washes and compared with a commercial liquid fabric softener. A 3 Kg laundry ballast was used in the machine. Softness was evaluated by a panel of six judges using 9 replicates. The results were as follows:

SOFTNESS EVALUATION

| Laundry Item | Softness Comparison |
|---|---|
| Terry towels | 1 unit dose softener composition of the invention provided equivalent softness to commercial liquid FS after 10 cumulative wash cycles |
| Cotton tee-shirts | 1 unit dose softener provided equivalent softness to commercial liquid FS after one wash cycle |
| Cotton kitchen towels | 1 unit dose softener provided enhanced softening relative to commercial liquid FS after one wash cycle |

EXAMPLE 2

A gelatin encapsulated unit dose liquid softener composition was prepared comprising the following ingredients:

| Ingredient | % (nominal) |
|---|---|
| PDMS[(1)] | 19.00 |
| Trioleate Glycerol | 15.00 |
| Sunflower Oil | 60.70 |
| Perfume | 5.30 |

[(1)]Polydimethylsiloxane

The softness provided by the unit dose composition was evaluated on cotton tee-shirts and towels in a European washing machine and compared with a commercial liquid fabric softener. The unit dose composition provided essentially equivalent softness.

What is claimed is:

1. A unit dose wash cycle fabric softening composition for softening or conditioning fabrics in the wash cycle of an automatic washing machine, said unit dose comprising (a) a compacted granular fabric softener composition or (b) an encapsulated liquid and/or granular fabric softener composition, said fabric softening composition comprising a montmorillonite-containing clay in combination with an organic fatty softening material which is a fatty alcohol or a pentaerythritol compound (PEC) selected from the group consisting of a higher aliphatic acid ester of pentaerythritol, an oligomer of pentaerythritol, a lower alkylene oxide derivative of an oligomer of pentaerythritol, and a mixture thereof, the amount of (a) or (b) being sufficient to form a unit dose capable of providing effective softening or conditioning of fabrics in the wash cycle of said washing machine.

2. A unit dose softening composition as in claim 1 characterized by being in the form of a tablet and having no discrete outer layer surrounding the fabric softener comprised of an alkaline material such that the pH of the wash water is increased upon the dissolution of said outer layer in said wash water.

3. A unit dose softening composition as in claim 1 wherein said softener clay is at least partially coated with said organic fatty softening material and serves as a carrier for such fatty softening material.

4. A unit dose softening composition as in claim 1 wherein said softening clay is bentonite and said PEC is a higher aliphatic ester of pentaerythritol or of an oligomer of pentaerythritol.

5. A unit dose softening composition as in claim 1 wherein the combination of clay and fatty softening material comprises, by weight, from about 50% to about 95% of bentonite and from about 5% to about 50% of said PEC.

6. A unit dose softening composition as in claim 5 wherein said combination of clay and fatty softening material comprises from about 80 to about 90% of bentonite and from about 10% to about 20% of said PEC.

7. A unit dose softening composition as in claim 1 wherein said fabric softener comprises a liquid fatty ester.

8. A unit dose softening composition as in claim 7 wherein said fatty ester is sunflower oil.

9. A unit dose softening composition as in claim 1 wherein said fabric softener composition comprises a liquid silicone.

10. A unit dose softening composition as in claim 1 wherein said fabric softener composition comprises a liquid oleyl alcohol.

11. A process for softening or conditioning laundry which comprises contacting the laundry with an effective amount of the unit dose softening composition of claim 1.

12. A process according to claim 11 wherein the fabric softener composition comprises a softening clay in combination with an organic fatty softening material.

13. A process according to claim 12 wherein said softening clay is bentonite and said organic softening material comprises a fatty alcohol or pentaerythritol compound (PEC) selected from the group consisting of a higher aliphatic acid ester of pentaerythritol, an oligomer of pentaerythritol, a lower alkylene oxide derivative of an oligomer of pentaerythritol, and a mixture thereof.

14. A process according to claim 11 wherein the fabric softener composition comprises a liquid fatty ester.

15. A process according to claim 11 wherein said fatty ester is sunflower oil.

* * * * *